United States Patent [19]

Garewal et al.

[11] Patent Number: 4,529,910

[45] Date of Patent: Jul. 16, 1985

[54] HIGH-PERFORMANCE ELECTRON GUN

[75] Inventors: Khem K. S. Garewal, Hoffman Estates; Arthur J. Ingle, Bartlett, both of Ill.

[73] Assignee: Zenith Electronics Corporation, Glenview, Ill.

[21] Appl. No.: 363,991

[22] Filed: Mar. 31, 1982

[51] Int. Cl.[3] ..... H01J 29/46; H01J 29/56

[52] U.S. Cl. ..... 315/15; 313/449

[58] Field of Search ..... 315/382, 14, 15; 313/414, 448, 449

[56] References Cited

U.S. PATENT DOCUMENTS 4,318,027 3/1982 Hughes et al. ..... 313/449

FOREIGN PATENT DOCUMENTS 2020092A 11/1979 United Kingdom .

OTHER PUBLICATIONS

"A Novel High-Voltage Bipotential CRT Gun Design", by R. H. Huges and H. Y. Chen, dated Feb. 9, 1979.

*Primary Examiner*—Theodore M. Blum
*Assistant Examiner*—Gregory C. Issing
*Attorney, Agent, or Firm*—Ralph E. Clarke, Jr.; Cornelius J. O'Connor

[57] ABSTRACT

A high-performance electron gun is disclosed capable of forming an ultra-small beam spot. The gun has a series of apertured electrodes of various dimension for receiving a range of electrical potentials for forming the beam spot on a cathodoluminescent screen located a predetermined throw distance from the end of the gun. Because of its capability in forming relatively small spot sizes of the order of ten mils or less, the gun finds application in high-resolution monitors, projection television tubes and in cathode ray tubes operating on the beam index principle.

9 Claims, 4 Drawing Figures

HIGH-PERFORMANCE ELECTRON GUN

BACKGROUND OF THE INVENTION AND PRIOR ART STATEMENT

This invention relates to television picture tubes, and is concerned primarily with an electron gun having performance characteristics suitable for beam index tubes and other cathode ray tube displays requiring small beam spots.

Electron guns that can provide relatively small spot sizes; that is, beam spot diameters of the order of ten mils or less, find application in high-resolution monitors and in cathode ray tubes operating on the beam index principle. Beam index displays have long been touted as a viable alternative to color television picture tubes utilizing the shadow mask. Ideally, the beam-index color television tube provides full color reproduction of a transmitted television signal by means of a single beam, and without the need for a shadow mask. This is a decided advantage in terms of image brightness as the shadow mask typically intercepts about 80 percent of the beam energy.

A beam index system essentially comprises a screen consisting of a pattern of triplets of phosphor stripes: red, green, and blue; an electron gun capable of projecting a beam spot of a diameter approximating stripe width; means for sensing spot location in relation to the patterns of triplets; and means for modulating the beam with picture information.

More than two hundred patents have been issued in the field of beam index tubes including such significant disclosures as U.S. Pat. Nos. 2,415,059 to Zworykin; 2,545,325 to Weimer; 2,587,074 to Sziklai; 2,742,531 to Partin; and 2,892,123 to Sunstein. Interest in the beam index system has persisted because of the theoretical advantages over the widely used shadow mask system; the advantages include lower energy consumption, higher resolution, and in single-beam systems, no convergence problems.

However, the attainment of a viable beam index system able to compete with the shadow mask system has yet to be realized. While seemingly simple in concept, the beam index system in practice has proved to be fraught with problems. A major problem inherent in the beam index system is the need for additional, complex circuitry required to detect the position of the beam landing area relative to the individual triplets of red, green and blue stripes which provide for color reproduction. It is mandatory for color purity and verity that the proper luminance and chrominance information impressed on the beam be applied to the particular phosphor stripe on which the beam is currently landing. If the beam does not apply red information to a red stripe, for example, but red information to an adjacent series of green or blue stripes, the color will be scrambled in a way highly visible to the viewer.

Another major problem, and one to which the present invention is addressed, concerns beam spot size. For proper operation, the width of the scanning spot must be no greater than the width of each of the discrete stripes and its guardband on which the beam impinges, and this size relationship must be maintained at all points on the imaging screen. An additional exacerbation lies in the fact that the color stripe must be relatively narrow to provide acceptable image definition;

e.g., preferably on the order of 10 mils, or less, in tubes of 13-inch diagonal measure.

A factor having a marked effect on spot size as the electron beam scans the picture imaging screen deposited on the face plate is the variance in the "throw" distance from the electron gun to a given point on the screen. The points of focus of the gun normally define an arc on the screen, while the area being scanned—the screen of the face plate—lies on an arc of much greater radius, hence is relatively planiform in comparison. As a result of scanning, the beam spot is undesirably gradationally enlarged from the minor axis to the minor sides of the face plate, culminating in an enlarged beam spot at the sides and the corners of the screen. As noted, it is mandatory that the width of the spot be substantially equal to the width of the stripes (and guardbands) if color purity is to be maintained. The enlargement of a beam spot at the sides of the screen, for example, may render it larger than the stripes/guardbands on which it is intended to impinge. The resulting overlap can result in hue and saturation errors. Also, a beam spot so enlarged can overlap a beam indexing stripe which can cause beam-indexing errors, as well.

Electron guns normally used in color television tubes are either the unipotential gun, which commonly has three electrodes in the main focusing lens, and the bipotential gun, which usually has a two-electrode main focus lens. The bipotential gun is in most common use. This type of gun normally has a relatively intermediate potential on the first, focusing electrode, and a relatively high potential on the second, accelerating electrode.

In UK Patent Application GB No. 2 020 092 A (RCA), there is disclosed a high potential, low magnification electron gun for use in color picture tubes. This bipotential-type gun comprises a cathode, an apertured plate control grid (Gl), an apertured plate screen grid (G2), and at least two tubular focusing electrodes (G3 and G4). It is stated that the quality of the gun's beam spot may be improved by (1) establishing an operating electric field between the G2 and G3 which is between about 100 and 400 volts/mil thereby reducing aberration effects in the beam-forming region of the gun; (2) making G2 thick so as to prevent the high G3 voltage from penetrating the region between G1 and G2, thereby allowing the G1–G2 field to provide a divergent effect on the electron beam prior to beam crossover and thus give a reduced crossover angle; (3) elongating G3 to provide an optimum filling of the main focus lens with a beam to maximize the object distance of the focusing system; and (4) structuring G2 and G3 to provide a flat electrostatic field therebetween to avoid prefocusing action in that region so as not to cause an effective reduction of the object distance of the focusing system. The focusing electrode (G3) potential is specified as being 8.5 kV and the accelerating anode (G4) potential is 30 kV.

OBJECTS OF THE INVENTION

It is a general object of this invention to provide an improved electron gun for use in cathode ray picture tubes.

It is a less general object of this invention to provide an electron gun capable of forming an ultra-small beam spot on the cathodoluminescent screen.

It is a more specific object of the invention to provide an electron gun capable of forming a spot of such diameter as to be usable in high-resolution monitors, projection television tubes and beam index tubes.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, in which:

FIG. 1A is an inset depicting a small area of the screen greatly enlarged;

DESCRIPTION OF THE PREFERRED EMBODIMENT

Figure 1:
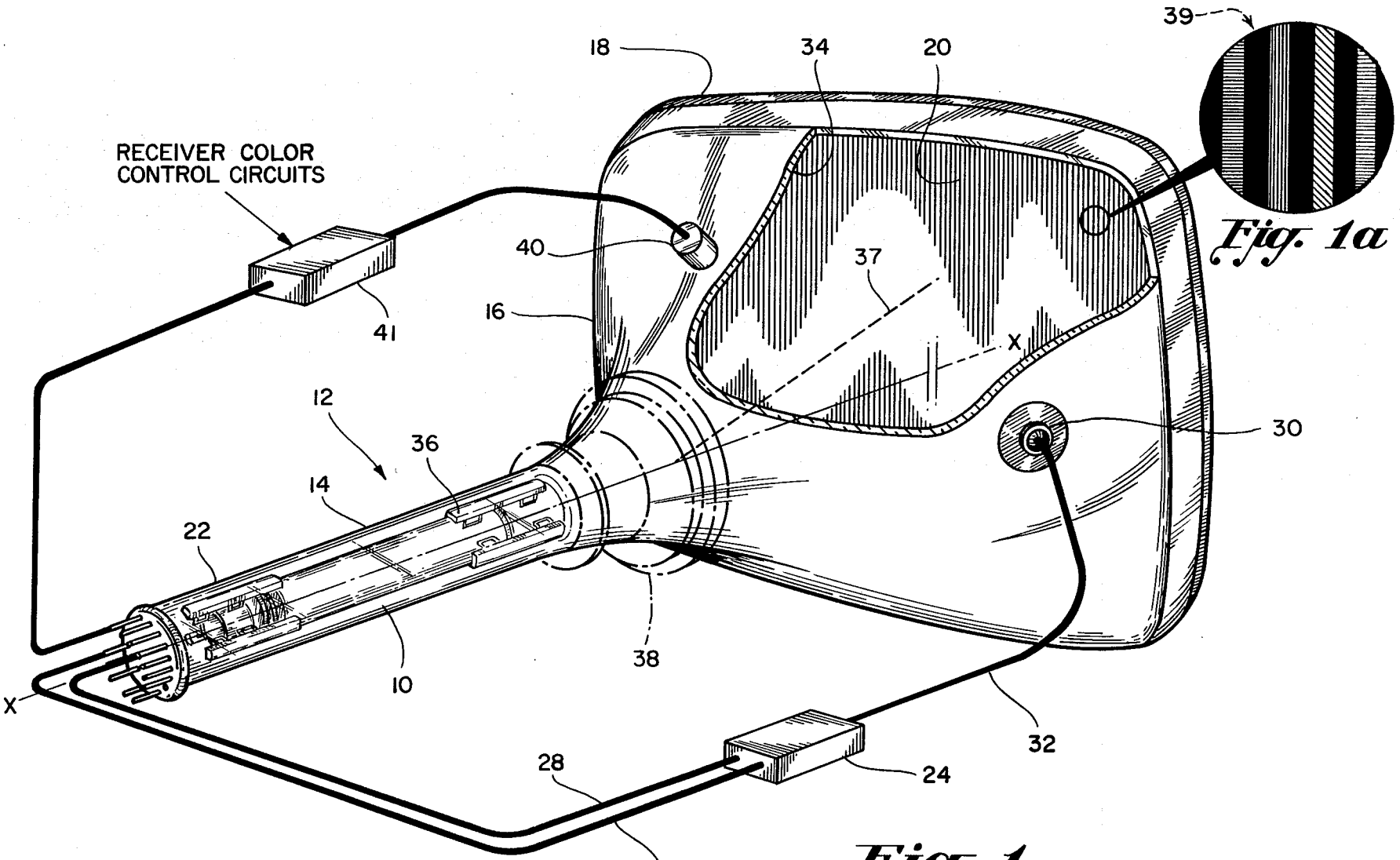
FIG. 1 is a view in perspective of an electron gun according to the invention as installed in a beam-index cathode ray tube depicted as being partly cut away.

A high-performance electron gun 10 according to the invention is shown in FIG. 1 as installed in a beam-index cathode ray tube 12, by way of example. The electron gun according to the invention is not limited to beam-index tube applications, but can be used in other cathode ray tube type systems requiring vary small beam spots.

The relationship of the electron gun 10 according to the invention with the picture tube 12 is indicated by FIG. 1. The primary components of picture tube 12 comprise an evacuated glass envelope including a neck 14, a funnel 16, and a face panel 18. On the inner surface of face panel 18 there is indicated an imaging screen 20. The electron gun according to the invention is indicated as being located within neck 14 substantially as shown. Gun 10 is normally installed in alignment with axis X—X of tube 12.

Power supply 24, also indicated schematically, is associated with cathode ray tube 12 for developing a predetermined pattern of supply voltages for gun 10 and tube 12. A special voltage divider circuit is typically incorporated in the power supply to provide a range of potentials required for tube and gun operation. For example, power supply 24 supplies a relatively low voltage of about 900 volts through an electrical conductor 26 depicted schematically as being connected to one of the pins indicated as extending from base 22. Power supply 24 also provides a relatively intermediate voltage of approximately 12,000 volts through another conductor 28 indicated schematically as being connected to another pin extending from tube base 22.

Power supply 24 also provides a relatively high voltage of about 30,000 volts to anode button 30 through a conductor 32. Anode button 30 in turn introduces the relatively high voltage through the funnel 16 to make internal contact with thin, electrically conductive coating 34 disposed on the inner surface of funnel 16, and extending part way into neck 14. An accelerating electrode of gun 10 receives the relatively high voltage through a plurality of gun centering springs extending from gun 10, and in physical contact with inner conductive coating 34.

Gun 10 is depicted in this example as emitting a single electron beam 37 for scanning the cathodoluminescent screen 20. Scanning of the beam is accomplished by means of a deflection yoke 38, shown schematically as encircling neck 14 and extending part way onto funnel 16.

Details of the cathodoluminescent screen 20 are indicated by the enlarged pattern of the associated inset (FIG. 1A) as comprising vertically oriented triplets of red-, green-, and blue-light-emitting phosphor stripes separated by lateral guardbands, indicated as being black. Each triplet has an associated index stripe 39 which is indicated as being located beneath the guardband between the blue and red stripes, as shown. The index stripe emits ultra-violet radiation when impacted by the beam 37. A photodetector 40, normally located in the funnel 16 of tube 12 as indicated, detects the emission from each index stripe as it is successively excited, generating a periodic indexing signal which is routed to a switching circuit 41. Switching circuit 41 provides for gating the red, green and blue color control signals from the television receiver color control circuits, and routes the signals through the base 22, as indicated schematically, to a control electrode of gun 10. By this means, the beam is modulated to apply the proper color information to the proper stripe in successive time sequence.

Figure 2:
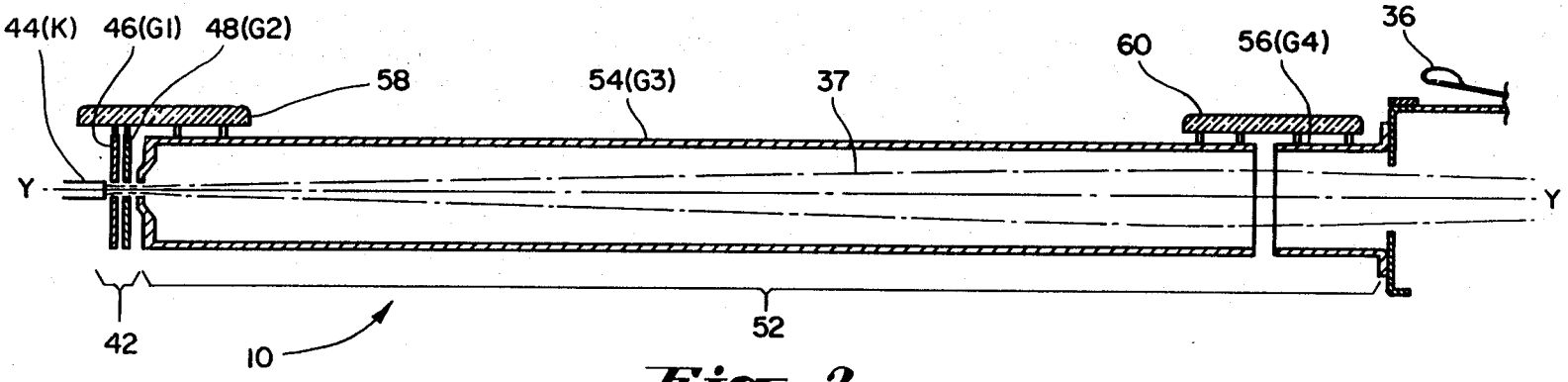
FIG. 2 is a longitudinal elevation in section showing details of a high-performance electron gun according to the invention.
Figure 3:
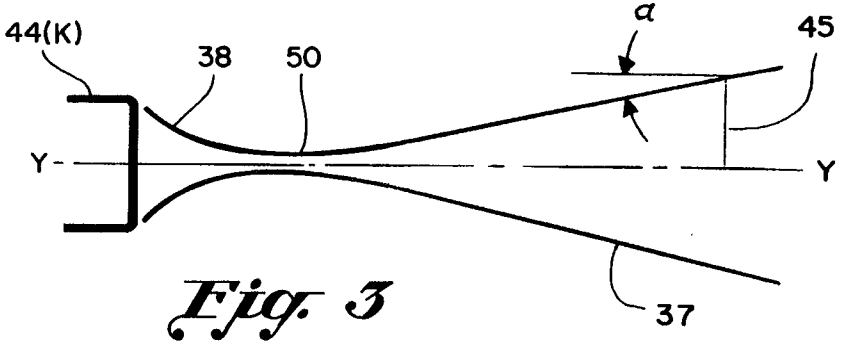
FIG. 3 is a diagram in profile of an electron beam indicating an entry angle defined with respect to the axis of the beam.

FIG. 2 is a detail view of a preferred embodiment of the electron gun 10 according to the invention, and FIG. 3 indicates the profile of the beam as formed in the lower end 42. Gun 10 is depicted as having a series of apertured electrodes aligned in spaced relation on an axis Y—Y for receiving the aforedescribed predetermined voltages from power supply 24 to produce a finely focused beam of electrons on screen 20. Gun axis Y—Y is substantially congruent with the axis X—X of tube 12. The electron gun according to a preferred embodiment of the invention comprises the following components in the order named.

Lower end means 42, indicated by the bracket, has a cathode 44(K) for developing the electron beam 37. Lower end means 42 further includes one apertured plate control electrode 46 (G1), and at least one (shown as being one) apertured plate cut-off electrode 48 (G2) for forming, in conjunction with the cathode 44, electron beam 37. An apertured plate electrode consists of a plate such as a disk or a rectangle having an aperture therethrough; this is in contradistinction to the "cylinder" electrode which is tubular.

Electrode 48 receives the aforedescribed low voltage of about 900 volts (with K at 190 V cut-off) from power supply 24 for developing, in conjunction with control electrode 46, a crossover 50 in beam 37, the general location of which lies between electrodes 46 and 48.

Main focus lens means 52, indicated by the bracket, provides for receiving, focusing and accelerating beam 37. Main focus lens 52 includes cylindrical focusing electrode means 54 (G3) for receiving, in the preferred embodiment of the invention, a beam focusing voltage of approximately 12,000 volts from power supply 24 for focusing a beam spot of minimum size on screen 20.

Main focus lens means 52 also includes a cylindrical accelerating electrode means 56 (G4) for receiving the relatively high beam accelerating voltage of approximately 30,000 volts, for example, from power supply 24 for accelerating beam 37. The ratio of the potentials of the voltage on the focusing electrode 54 and the voltage on the accelerating electrode 56 is in the range of 0.3 to 0.5, and preferably about 0.4.

Gun centering springs 36 extend from accelerating electrode 56 to make contact with the inner conductive coating 34. The cathode assembly and the electrodes G1–G4 are indicated as being fixed in proper relationship and alignment by multiform glass beads 58 and 60. Three sets of beads are normally used in each group, located 120 degrees apart.

The gun length, as measured from the face of cathode 44 to the end of accelerating electrode 56 is, by way of example, about 5.5 inches. The "throw distance"; that is, the distance from the accelerating electrode 56 to the landing point of beam 37 at the center of screen 20 is about eight inches. The throw distance is also referred to as the Q-distance. The ratio of the length of gun 10 to the throw distance is in the range of 0.3 to 2.0 and preferably is a ratio of about 0.69. The focusing electrode 54 lens diameter to electrode length ratio is in the range of 0.07 to 0.11, and preferably is a ratio of about 0.09. The focusing electrode 54 length to the gun 10 length ratio is in the range of 0.85 to 0.90, and preferably is a ratio of about 0.88.

The parameter that contributes most to providing an ultra-small beam spot in the gun according to the invention is the degree of magnification of the cross-over, preferably a very low magnification of the cross-over, with the cross-over also preferably small. Magnification M is expressed $$M = \frac{q}{p} \cdot \sqrt{\frac{V_f}{V_a}}$$

where $V_f$ is the focusing voltage on the electrode 54, $V_a$ is the accelerating voltage on electrode 56, q is the distance from the second principal plane of the main focus lens to the image as it falls on the center of the screen, and where p is the distance from the first principal plane of the main lens to virtual object. But q is approximately Q which is the throw distance and p is approximately proportional to $L_3$, the $G_3$ length. Moreover $V_f$ is approximately proportional to $L_3$; hence $$M \approx \frac{Q}{k_p L_3} \cdot \sqrt{\frac{k_f L_3}{V_a}}$$

where $k_p$, $k_f$ are constants of proportionality. Since Q and $V_a$ are fixed for a given design, we may define K, wherein $$K = \frac{Q}{k_p} \cdot \sqrt{\frac{k_f}{V_a}}$$

which is a constant. Then with regard to magnification, M $$M \approx \frac{K}{\sqrt{L_3}}$$

The magnification of the electron gun according to the invention is very low; that is in the range of 0.5 to 2.5, and preferably less than 1.5. The virtual cross-over is also very small—3.0 mils in diameter by way of example. The entry angle is also small—12.5 milliradians, for example. The low magnification of the very small cross-over results in a beam spot of 10 mils or less at center screen, which is suitably small for use in a beam-index tube or a high-resolution monitor. In contrast, a typical bipotential three-color television electron gun normally operates with an entry angle of about 75 milliradians at 4.0 milliamperes of beam current, and the center screen spot size is typically in the 100–140 mil range.

Beam spot size is specified as being 10 mils or less. Beam spot size is defined as the diameter from edge-to-edge of the beam expressed in mils at a landing point on screen 20, typically at center screen. The "edge" of a beam is defined as those points near the circumference of the beam where the current density due to fall-off is only ten percent of the peak density at the center of the beam. The electron gun according to the invention forms a beam spot having a diameter of approximately ten mils or less on the screen 20 at a "throw" distance of about eight inches. This approximately ten mil spot size is noted as being produced at a beam current of about 250 microamperes. At a higher beam current of 500 microamperes, for example, the spot size is about fifteen mils.

An electron beam diverging from the cross-over defines a "half angle" with respect to the axis of the gun. The half angle is essentially a measure of beam growth in diameter as the beam diverges from the cross-over. The half angle is variously termed a "semi-angle" or a "divergence angle". In this disclosure, it is designated by the more discriptive term "entry angle" as it denotes the angle of the beam envelope upon its entry into the main focus lens.

An entry angle and means for its measure are indicated schematically in FIG. 3. The cathode 44 (K) is indicated as emitting a stream of electrons which is formed into the beam 37. A cross-over 50 is formed from which beam 37 diverges. The entry angle of expansion of beam 37 defines an angle $\alpha$ with respect to the axis Y—Y of the electron gun. Angle $\alpha$ is measured from a selected "cut line" 45, which is, approximately 1 to 3 aperture diameters into electrode 54 where there exists essentially a field-free region.

The magnitude of an entry angle depends in a measure on the electro-mechanical design parameters of the lower end section of the electron gun. The factors that affect formation on the cross-over and subsequent prefocusing of the beam prior to its entry into the main focus lens, and the resultant entry angle, include the configuration of the first and second electrodes 46 and 48; spacing between the cathode and the first electrode 46, between the first and second grids, between the second and the following electrode 54 of the main focus lens 52; aperture sizes; and the configurations of the electrodes as designed to establish the prefocusing fields. The slope is established essentially by the difference in potential of the electrodes of the lower end 42, the spacing between the electrodes, and the diameters of the electrode apertures.

The gun according to the invention is specified as having a very low magnification M, noted as preferably being 1.5, or less. Given low magnification, which makes for a very small magnified cross-over, there is also the requirement for a low spherical aberration. The spherical aberration component is desirably one-third to one-quarter of the magnified cross-over.

It is essential in electron gun design, whether the gun be a bipotential or other, that the beam entry angle and apparent source position be of the proper value so that the beam will optimally fill the main focus lens. If this optimum filling is accomplished, the total effect from spherical aberration, object magnification and space charge repulsion will be minimized, and a beam spot of minimum diameter will be focused on the phosphor screen. The very small entry angle of 12.5 milliradians fulfills this requirement for the preferred embodiment.

A preferred embodiment of the main focus lens and electron gun according to the invention has the following approximate dimensions:

| | Inch(es) |
|---|---|
| G3 aperture diameter | 0.065 |
| G3 thickness at aperture | 0.010 |
| G3 length; | 4.850 |
| G3 lens diameter | 0.437 |
| G3 to G4 spacing; | 0.050 |
| G4 length; | 0.500 |
| G4 lens diameter; | 0.437 |
| Gun length; | 5.5 |

The electron gun according to the preferred embodiment of the invention operates with the following approximate electrical potentials:

| | Volts |
|---|---|
| K potential (at cut off) | 190 |
| G1 potential | 0 |
| G2 potential (with K at cut off) | 900 |
| G3 potential | 12,000 |
| G4 potential | 30,000 |

While particular embodiments of the invention have been shown and described, it will be apparent to those skilled in the art that changes and modifications may be made without departing from the invention in its broader aspects, and therefore, the aim of the appended claims is to cover all such changes and modifications as fall within the true spirit and scope of the invention. The matter set forth in the foregoing description and accompanying drawings is offered by way of example only and is not intended as a limitation. The actual scope of the invention is intended to be defined in the following claims when viewed in their proper perspective based on the prior art.

I claim:

1. A high-performance electron gun capable of forming an ultra-small beam spot, said gun having a series of apertured electrodes of various dimensions for receiving a range of electrical potentials for forming said beam spot on a cathodoluminescent screen located a predetermined throw distance from the end of said gun, said electrodes including, and in the order named, a cathode, an apertured plate control electrode, an apertured plate cut-off electrode, a cylindrical focusing electrode, and a cylindrical accelerating electrode, said gun being characterized by having a magnification in the range of 0.5 to 2.5, said focusing electrode and accelerating electrode being adapted to receive a focusing-electrode-potential-to-accelerating electrode potential ratio in the range of 0.3 to 0.5; a gun-length-to-throw-distance-ratio in the range of 0.3 to 2.0, a focusing-electrode-lens-diameter-to-electrode-length ratio in the range of 0.07 to 0.11, and a focusing-electrode-length-to-gun-length ratio in the range of 0.85 to 0.90.

2. The electron gun according to claim 1 wherein said magnification is a magnification of less than 1.5.

3. The electron gun according to claim 1 wherein said focusing-electrode-potential-to-accelerating-electrode-potential ratio is about 0.4.

4. The electron gun according to claim 1 wherein said gun-length-to-throw-distance ratio is about 0.69.

5. The electron gun according to claim 1 wherein said focusing-electrode-lens-diameter-to-electrode-length ratio is about 0.09.

6. The electron gun according to claim 1 wherein said focusing-electrode-length-to-gun-length ratio is about 0.88.

7. The main focus lens of the electron gun of claim 1 having the following approximate dimensions:

| | Inch(es) |
|---|---|
| G3 aperture diameter; | 0.065 |
| G3 thickness at aperture; | 0.010 |
| G3 length; | 4.850 |
| G3 lens diameter; | 0.437 |
| G3 to G4 spacing; | 0.050 |
| G4 length; | 0.500 |
| G4 lens diameter; | 0.437 |
| Gun length; | 5.5 |

8. The electron gun of claim 1 having the following approximate electrical potentials:

| | Volts |
|---|---|
| K potential (at cut off); | 190 |
| G1 potential; | 0 |
| G2 potential (with K at cut off); | 900 |
| G3 potential; | 12,000 |
| G4 potential; | 30,000 |

9. A high performance electron gun comprising a series of apertured electrodes aligned in spaced relation on an axis including cylindrical main focus lens electrodes in the order named, a focus electrode (G3), and a accelerating electrode (G4), said gun being characterized by having a magnification of less than 1.5, and the following approximate ratios:

a G3 lens diameter to G3 length ratio of about 0.09;

a G3 electrode potential to G4 electrode potential ratio of about 0.4;

a gun length to throw distance ratio of about 0.69; and a G3 electrode length to gun length ratio of about 0.88.

* * * * *